US005348676A

United States Patent [19]

Takashima et al.

[11] Patent Number: 5,348,676

[45] Date of Patent: Sep. 20, 1994

[54] LUBRICATING OIL COMPOSITION FOR FOOD PROCESSING MACHINERIES

[75] Inventors: Hiroyuki Takashima; Mitsuo Okada, both of Yokohama; Teruo Shimizu, Omiya, all of Japan

[73] Assignee: Nippon Oil Co., Ltd., Tokyo, Japan

[21] Appl. No.: 67,326

[22] Filed: May 25, 1993

[30] Foreign Application Priority Data

May 25, 1992 [JP] Japan ..... 4-157523

[51] Int. Cl.[5] ..... C10M 105/32

[52] U.S. Cl. ..... 252/56 R; 252/565

[58] Field of Search ..... 252/56 S, 56 R

[56] References Cited

U.S. PATENT DOCUMENTS 2,700,022 1/1955 Clayton et al. ..... 252/56

FOREIGN PATENT DOCUMENTS 0011419 5/1980 European Pat. Off. .
0382512 8/1990 European Pat. Off. .
1644871 9/1970 Fed. Rep. of Germany .
262663 12/1988 Fed. Rep. of Germany .
56-72651 6/1981 Japan .
57-67695 4/1982 Japan .
61-17343 1/1986 Japan .
62-32841 2/1987 Japan .
2209995 8/1990 Japan .

OTHER PUBLICATIONS

European Search Report for European Patent Application EP 93 30 4009, Aug. 25, 1993 (2 pages).
Abstract of Japanese Patent 5 039 497, prepared by Derwent Publications Ltd. Feb. 19, 1993.

*Primary Examiner*—John Niebling
*Assistant Examiner*—Edna Wong
*Attorney, Agent, or Firm*—Panitch Schwarze Jacobs & Nadel

[57] ABSTRACT

A lubricating oil composition comprises a mixture of a first ester of medium-chain saturated fatty acid and glycerol and a second ester of sucrose and carboxylic acid. The composition has improved physical characteristics including high hygienic safety, increased oxidative stability, enhanced lubricating performance, adequate viscosity and other properties required for lubricating particularly food processing machineries and implements.

5 Claims, No Drawings

LUBRICATING OIL COMPOSITION FOR FOOD PROCESSING MACHINERIES

BACKGROUND OF THE INVENTION

1. Field of the Invention

This invention relates to lubricating oil compositions and more particularly to a lubricating oil composition which is particularly suitable for lubricating machineries and implements for processing marine, farm, livestock and other food products.

2. Prior Art

Food processing for livestock, marine, farm or other stock materials involve the steps of selection, classification, pulverization, mixing, baking, heating, fermentation, boiling, drying, cooling and so on. These processing steps require their respective machines and instruments such as tea-leaf collecting machine, gain polishing machine, flour grinder, brewing machine, baking and confectioneries making machines, machines for making fruit juice, jams and pickles, milk processing machine, ham/sausage making machine, fish-meat and seaweed processing machine, vacuum film evaporator or kneader for preparing food additives, natural flavours and medicines, and many other machines and implements employed for making or processing a variety of food items.

Hithertofore used as lubricating oils for such machines and implements are a mineral oil or liquid paraffin, a liquid vegetable oil such as soybean oil, cottonseed oil and rape oil as well as an animal fat and oil such as beef or pork fat. Mineral oils and liquid paraffins are considered objectionable in terms of sanitation as they tend to move from the operative parts of the machine into and mingle with the food material being processed. While liquid vegetable fats and oils are hygienically acceptable, they are less oxidatively stable as may be determined by the Active Oxygen Method (AOM) hereinafter described.

A specific example of fats and oils (1) is disclosed in Japanese Laid-Open Patent Publication No. 56-72651 wherein a spray lubricant is proposed which comprises an ester exchange product of 30–90 parts by weight of an edible fat and oil containing 20 or less percent by weight of a saturated fatty acid and 70–10 parts by weight of a composition chiefly consisting of an ester of medium-chain saturated fatty acid and triglycerol hereinafter referred to as MCT having 6–10 carbon atoms.

Japanese Laid-Open Patent Publications 57-67695 and 62-32841 both propose the use of an ester-exchanged product of a fat and oil composition (2) derived from hydrogenative treatment of a vegetable oil such as camellia oil, tea blossom oil, olive oil, safflower oil, hazelnut oil and rape oil, the treated product having 16 or less percent by weight of linoleic acid and 12 or less percent by weight of saturated fatty acid.

Japanese Laid-Open Patent Publication 61-17343 discloses the use of a high-stability liquid oil (3) comprising an ester exchange product of a hydrogenated vegetable oil having 5 or less percent by weight of linoleic acid and MCT, which product has an AOM value of greater than 250 hours.

Japanese Laid-Open Patent Publication 62-3281 introduces a hydrogenated vegetable oil (4) of 80–95 iodine value ester-exchanged with a lauric acid, the ester-exchanged product having an AOM of 52–93 hours Japanese Laid-Open Patent Publication 2-209995 discloses the use of a lubricating oil (5) for food processing machines which chiefly comprises triglyceride having a straight-chain alkyl group of 5–21 carbon atoms blended with a fatty acid of 12–22 carbon atoms.

The above lubricating oils (1)–(4) have a common drawback in that they are adequately resistant to oxidation due to the presence of increased unsaturated acids emanating from vegetable oils being hydrogenated to reduce polyenic acid contents and increase oleic acid contents.

The last-mentioned oil (5) is a MCT-based oil reputed for its high oxidative stability and low cloud point. This oil per se, however, has a relatively low viscosity ranging from 15–20 cp at 25° C. to 10–15 cp at 40° C. which is not readily adjustable to suit a particular application required by specific drive or operative component parts of a food processing machine.

There may be considered certain vegetable oils having a relatively high viscosity and such vegetable oils further hydrogenated or ester-exchanged. However, such vegetable oils are susceptible to deterioration by oxidation or solidification by polymerization due to the presence of unsaturated bonds in the fatty acid molecule, often resulting in seized machinery parts. It is known that linoleic acid and linolenic acid respectively have oxidation rates at 20° C. of 12–20 times and about 25 times greater than that of oleic acid. Esters of saturated acid and glycerol are regarded to have a relatively high oxidative stability. Methyl stearate is known to have an oxidation rate about one-eleventh of that of methyl oleate or about one-hundredth of that of methyl linoleate.

Hydrogenation may be resorted to for reducing linoleic and linolenic acids in the glyceride with an increase in the contents of oleic acid to provide enhanced oxidative stability. However, this is not quite satisfactory because oleic acid is also an unsaturated fatty acid.

There may be considered certain highly viscous fats and oils such as those which contain large proportions of miristic acid, palmitic acid, stearic acid and other saturated fatty acids for use in the lubrication of food processing machineries. Such fats and oils are highly resistant to oxidation but have objectionably high cloud point, meaning high pour point and high freezing point. In order to reduce their cloud point, it may be possible to react high-viscosity fats and oils for ester exchange with MCT but only with appreciable effect.

SUMMARY OF THE INVENTION

With the foregoing drawbacks of the prior art in view, the present invention seeks to provide an improved fat and oil composition which is highly satisfactory in respect of requisite physical properties including hygienic safety, viscosity, oxidative stability, cloud point, low temperature fluidity and lubricating performance and which therefore finds effective application particularly in lubricating food processing machineries and implements.

The above and other features and advantages of the invention will be more apparent from the following detailed description.

According to the invention, there is provided a lubricating oil composition useful for lubricating food processing machineries and implements which comprises a mixture of a first ester of medium-chain saturated fatty acid and glycerol and a second ester of sucrose and carboxylic acid.

DETAILED DESCRIPTION OF THE INVENTION

A fat and oil composition according to the invention essentially comprises a first ester of medium-chain saturated fatty acid and glycerol (referred to herein as Component A) and a second ester of sucrose and carboxylic acid (referred to herein as Component B).

The term medium-chain saturated fatty acid for Component A as used herein designates a range of fatty acids having a carbon number of 6–10 which exemplarily include caproic acid, heptylic acid, caprylic acid, nonylic acid and captic acid. These saturated fatty acids may be used singly or in combination.

Component B of the inventive composition is a high molecular weight compound available from the esterification of sucrose and carboxylic acid, which compound is called a sugar ester and has an average molecular weight of 400–2,000 and a Brookfield viscosity of 50,000–150,000 cp, preferably 80,000–120,000 cp at 30° C. and 50–300 cp, preferably 70–150 cp at 100° C. The carboxylic acid under contemplation is a straight-chain, branched, saturated or unsaturated carboxylic acid having a carbon number of 2–12, preferably 2–6. Those carboxylic acids which are saturated are particularly preferred in terms of oxidative stability. Preferred examples of such carboxylic acid eligible for the purpose of invention include acetic acid, propionic acid, butyric acid, isobutyric acid, caproic acid, isocaproic acid and mixtures thereof.

It has now been found that particularly suitable as Component B of the invention is a colorless or light yellow viscous liquid which can be derived from the esterification of sucrose, acetic acid anhydride and isobutyric acid anhydride and which significantly contributes to improvement in viscosity, oxidative stability and cloud point of the resultant composition.

Blends of the inventive composition are usually in the range of 20–95 percent by weight, preferably 50–95 percent by weight for Component A and in the range of 5–80 percent by weight, preferably 5–50 percent by weight for Component B, based on total composition.

To provide enhanced performance characteristics of the lubricating composition of the invention, there may be used various kinds of additives which for example include an antioxidizing agent such as ascorbic acid, fatty acid ester thereof, tocopherol, 2,6-di-t-butyl-4-hydroxytoluene and 2,6-di-t-butyl-4-hydroxyanisole, and a rust-proofing agent such as stearic acid, oleic acid, behenic acid and sorbitan monooleate. These additives may be used singly or in combination usually in an amount of 10–20 percent by weight based on total composition.

The invention will be further described in connection with the Inventive and Comparative Examples tabulated in Table 1 which show the respective lubricating oil compositions with resultant test data.

TABLE 1

| | Inventive Ex. | | | | Comparative Ex. | | |
|---|---|---|---|---|---|---|---|
| | 1 | 2 | 3 | 4 | 1 | 2 | 3*3 |
| MCT*1 (wt %) | 80 | 60 | 50 | 30 | — | 100 | 30 |
| SB*2 (wt %) | 20 | 40 | 50 | 70 | — | — | — |
| palm hardened oil (wt %) | — | — | — | — | — | — | 70 |
| rape salad oil (wt %) | — | — | — | — | 100 | — | — |
| oxidative stability (min) | 460 | 450 | 440 | 430 | 12 | 600 | 350 |
| wear resistance (mm) | 0.50 | 0.45 | 0.40 | 0.39 | 0.44 | 0.52 | 0.50 |
| viscosity (cSt, @40° C.) | 19 | 39 | 63 | 200 | 30 | 12 | 20 |
| cloud point (°C.) | <−10 | <−10 | <−10 | <−10 | <−10 | <−10 | +10 |

Note:
*1 is a triglyceride having randomly distributed in the molecule 85% of $C_8$ (caprylic acid) and 15% of $C_{10}$ (capric acid).
*2 is an ester of sucrose, acetic acid and isobutyric acid having an average molecular weight of about 850 (produced by Eastman Chemical Products Inc.)
*3 is a product of esterification of 30 weight % of MCT and 70 weight % of palm hardened oil containing 18 weight % of unsaturated fatty acid.

The above tabulated performance tests were conducted as follows:

(1) Oxidative Stability

Oxidative resistance life (by minute) was measured at 120° C. using "Rotary Bottle Oxidative Stability Test Method" stipulated by JIS K 2514 3.3.

(2) Wear Resistance

The extent of wear (by millimeter in diameter) was determined by "Wear Preventive Characteristics of Lubricating Fluid (Four-Ball Method)" under conditions of 1,200 rpm, 15 kg and 30 minutes according to ASTM D 4172.

(3) Viscosity

Dynamic viscosity was measured at 40° C. pursuant to the "Crude Oil and Petroleum Products Dynamic Viscosity Test Method and Petroleum Products Viscosity Index Calculation Method" stipulated by JIS K 2283.

(4) Cloud Point

This was measured according to the standard method of analysis of oils and fats 2.3.7-71, by the Japanese Society of Oil and Fat Chemistry.

What is claimed is:

1. A lubricating oil composition useful for lubricating food processing machineries and implements comprising a mixture of (a) a first ester of glycerol and a medium-chain saturated fatty acid, where the medium-chain saturated fatty acid has carbon number of 6–10, and (b) a second ester of sucrose and a carboxylic acid, where the carboxylic acid has a carbon number of 2–12.

2. A lubricating oil composition according to claim 1 wherein said medium-chain saturated fatty acid is selected from the group consisting of caproic acid, heptylic acid, caprylic acid, nonylic acid and captic acid.

3. A lubricating oil composition according to claim 1 wherein said carboxylic acid is selected from the group consisting of acetic acid, propionic acid, butyric acid, isobutyric acid, caproic acid and isocaproic acid.

4. A lubricating oil composition according to claim 1 wherein said first ester is present in an amount of 20–95 percent by weight based on the total composition.

5. A lubricating oil composition according to claim 1 wherein said second ester is present in an amount of 5–80 percent by weight based on the total composition.

* * * * *